US005085147A

United States Patent [19]

Gold et al.

[11] Patent Number: 5,085,147

[45] Date of Patent: Feb. 4, 1992

[54] DISTRACTION DEVICE

[76] Inventors: Robert J. Gold, 12407 MoPac Expressway N. 100, Suite 191, Austin, Tex. 78758; Wesley C. Leffel, 310 Bushnell Way, Grants Pass, Oreg. 97527; Albert G. Myka, P.O. Box 5337, Orange, Calif. 92613

[21] Appl. No.: 591,674

[22] Filed: Oct. 1, 1990

[51] Int. Cl.[5] ..... F42B 8/12

[52] U.S. Cl. ..... 102/486; 102/487; 89/1.11

[58] Field of Search ..... 102/482, 486, 487, 368, 102/498, 334, 367, 353, 445, 473, 502; 89/1.11

[56] References Cited

U.S. PATENT DOCUMENTS

| | | | |
|---|---|---|---|
| 2,094,562 | 9/1937 | Lowy | 102/368 |
| 2,356,389 | 8/1944 | Decker et al. | 102/487 |
| 3,318,033 | 5/1967 | Barr | 42/483 |
| 3,427,973 | 2/1969 | Beers | 102/334 |
| 3,434,421 | 4/1969 | Berlin et al. | 102/487 |
| 3,482,517 | 12/1969 | Angelos et al. | 102/334 |
| 3,705,552 | 12/1972 | Lerman | 102/487 |
| 3,782,288 | 1/1974 | Berlin et al. | 102/487 |
| 3,792,661 | 2/1974 | Turetsky et al. | 102/482 |
| 4,656,946 | 4/1987 | Gordan et al. | 102/438 |
| 4,932,328 | 6/1990 | Pinkney et al. | 102/482 |

*Primary Examiner*—Michael J. Carone
*Attorney, Agent, or Firm*—Walter C. Farley

[57] ABSTRACT

A stun grenade includes a tubular housing to slidably receive a munitions canister. A cup-shaped end cap closes one end of the housing and frictionally engages an outer wax-coated surface of the housing adjacent the end. At the other end a fuze retention disk is retained in the housing and has a threaded opening to receive any one of several possible fuze assemblies. When using a manually operable fuze, the handle thereof is provided with a color-coded coating to identify the nature of the explosive charge provided in the grenade. The handle also has one or more lumps formed thereon to provide a tactile code, consistent with the color, to identify the grenade type. The fuze retention disk includes spikes establishing a fixed spacing between the munitions canister and the fuze held in the fuze retention disk.

9 Claims, 5 Drawing Sheets

DISTRACTION DEVICE

SPECIFICATION

This invention relates structure and particularly to a distraction stun grenade device has improved explosive characteristics, improved launching capabilities and improved reliability as to the repeatability of its performance.

BACKGROUND OF THE INVENTION

Various types of grenades are known, including those intended for launching by hand or using projectile launchers. Grenades can also be classified by those intended primarily for lethal use as distinguished from those which are intended to stun and confuse the target individuals. Grenades intended for wartime military use wherein maximum destruction is usually desired can differ from those intended for use with more marginal situations such as dealing with terrorists and the like.

Of those intended primarily to stun or distract a class which includes the present invention, the components thereof have been designed and assembled in various ways but generally have the disadvantage of poor repeatability in performance. This is traceable to construction techniques, including the use of adhesives which are affected by moisture, temperature and age and which therefore have unpredictable separation characteristics. For those grenades in which the charge is intended to separate from the grenade carrier at the time of detonation, this unpredictability can be a serious problem. The result is that the distances of separation of the charge from the carrier housing are widely variable and it is extremely difficult to use such munitions with assurance and effectiveness. In a critical situation, one cannot be sure whether the grenade he is about to use will or will not operate in the intended fashion.

SUMMARY OF THE INVENTION

Accordingly, an object of the present invention is to provide an improved structure for a grenade which results in reliable, repeatable performance.

Another object is to provide a grenade which can be adapted for launching or discharge in a variety of ways with the simple interchange of an activating component.

Another object is to provide a grenade base capable of accepting a special launchable submunition which is capable of being hand launched or launched from a stationary base to a distance greater than the rock-throwing distance of rioters.

Another object is to provide a grenade base that is mountable on aircraft and which allows the dispersal of the special launchable submunition from the air.

A still further object is to provide a grenade which is constructed so that certain components thereof are reusable thereby reducing cost and problems associated with the availability of components.

Briefly described, the invention includes a grenade comprising a generally tubular housing having opening ends, a munitions container slidably received within said housing and a cup-shaped end cap closing one end of the housing and surrounding part of the outer surface of the housing adjacent the one end, the end cap sealed with controlled moisture and friction fit so as to create a vacuum bond between a waxed surface and the vinyl cap when placed together engaging the outer surface of the housing. A closure means at the other end of the housing is attachable to a fuze, the closure means including a fuze retention disk comprising a main body, an annular flange protruding radially from the main body and means defining an internally threaded opening passing through the main body for receiving the fuze, the fuze retention disk being secured in the end of the housing opposite the end cap.

BRIEF DESCRIPTION OF THE DRAWINGS

In order to impart full understanding of the manner in which these and other objects are attained in accordance with the invention, particularly advantageous embodiments thereof will be described with reference to the accompanying drawings, which form a part of this specification and wherein.

DESCRIPTION OF THE PREFERRED EMBODIMENTS

Figure 1:
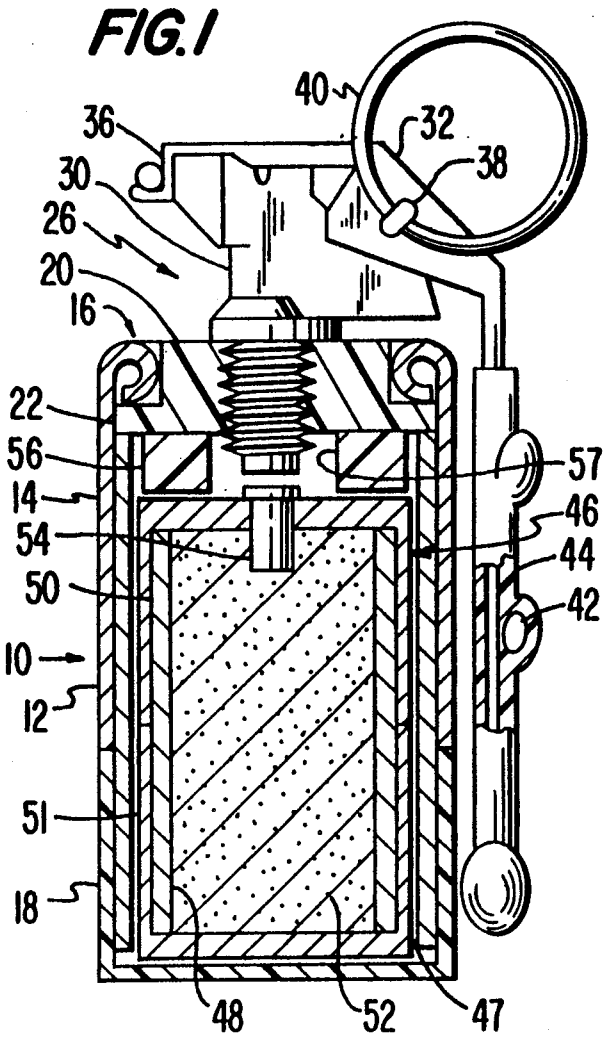
FIG. 1 is a side elevation, in partial section, of a grenade in accordance with the present invention.
Figures 2, 8:
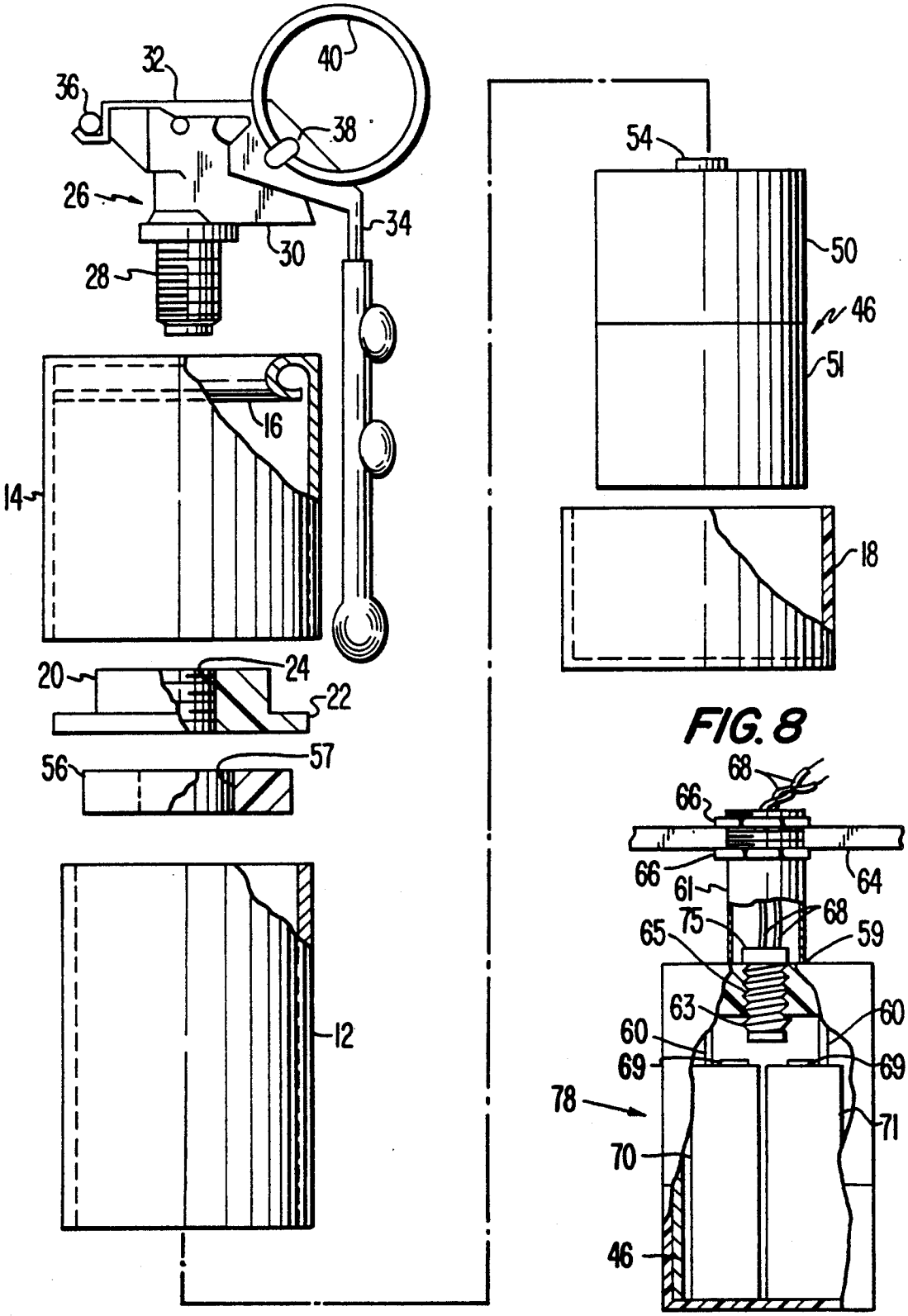
FIG. 2 is an enlarged, exploded view of the grenade of FIG. 1 showing the individual components thereof.
FIG. 8 is a side elevation, in partial section, of a still further embodiment of a grenade in accordance with the present invention.

Referring first to FIGS. 1 and 2, the grenade of the present invention includes a housing indicated generally at 10 which forms the body of the grenade and which has a tubular cylindrical sleeve 12, the upper portion of which is enclosed within a shorter tubular sleeve 14, the upper end of which is curled inwardly as shown at 16 to form a rim of reduced diameter. The lower portion of sleeve 12 is surrounded by a flexible end cap 18 which, in addition to surrounding that portion of sleeve 12, closes the lower end of the housing.

Sleeves 12 and 14 are preferably made of cardboard and the outer surfaces of sleeves 12 and 14 are coated with wax. End cap 18 is made of a relatively soft and flexible plastic such as a soft polyvinyl chloride and is formed separately from the remainder of the grenade with an inside diameter which is initially smaller than the outer diameter of sleeve 12. At the time of assembly, end cap 18 is stretched outwardly and forced over sleeve 12 to form a tight friction fit. After assembly, the end cap has a very tight fit having predetermined, controlled and uniform grip characteristics with sleeve 12.

At the upper end of the grenade is a fuze retention disk 20 which is circular in plan and which has a main body portion surrounded by a radially outwardly protruding flange 22, resulting in a structure having a "top hat" shape. Flange 22 is significantly thinner than the central, main body portion, preferably less than ½ the thickness of the central portion, and is clamped between the rim formed by rolled portion 16 of sleeve 14 and the upper end of the sleeve 12. At the center of body 20 is an internally threaded opening 24 to receive the threaded stem 28 of a fuze device indicated generally at 26.

In the embodiment of FIGS. 1 and 2, the manually operable fuze device 26 is of a conventional nature. A standard military fuze known as a type M201A, having a delay of about 1.8 seconds is preferably used, fuze structures of this general type being shown, for example, in U.S. Pat. Nos. 3,782,288, Berlin et al, and U.S. Pat. No. 3,705,552, Lerman. Fuze 26 has an externally threaded stem 28 which is threaded through disk 20. Stem 28 is attached to a body 30 which carries a detonation device including a spring-actuated mechanism, not specifically illustrated, which is held in a restrained position by a safety spoon 32. Spoon 32 has a handle 34 which can be manually grasped, one end of the spoon being engaged in a pivot latch arrangement with a pivot pin 36. Spoon 32 is locked in the restraining position by a latching pin 38 which can be manually removed by a pull ring 40.

An additional feature in accordance with the present invention includes one or more bodies 42 of metal or other material, the bodies being adhered to the handle 34 of spoon 32 and then covered by a vinyl or other plastic coating 44, the thickness of the coating being essentially uniform over the handle so that bodies 42 produce easily recognizable bumps along the handle. The purpose of these bumps is to provide a means for identifying the nature of the grenade by touch in special conditions such as, for example, in total darkness. Coating 44 is also colored in a fashion consistent with the number of bumps so that, in reasonable light as well as in darkness, the type of grenade can be rapidly recognized without having to read a label. For example, one bump on the handle might identify a grenade having a single charge with single explosion characteristics while three bumps might identify a grenade with multiple charges and a high flash mixture in the munitions canister.

Within the housing is a submunition canister 46. Various types of submunitions can be used. The type illustrated in FIGS. 1 and 2 includes an internal tubular sleeve 48 and upper and lower cup-like portions 50 and 51 which are assembled around sleeve 48 to contain a charge 52 of explosive material therein. A delay fuze 54 extends through the upper end of container portion 50. It is important to note that canister 46 is smaller than the interior of the housing, leaving an air space 47 which is important to the proper operation of the grenade.

Of particular importance is separation disk 56 which is an annular body having a central opening 57, the body being made of a light but substantially rigid foam material (such as foamed polystyrene) or cardboard. The purpose of disk 56 is to establish and maintain a predetermined spacing between the facing surfaces of fuze 28 and the delay fuze 54 on the top of the submunition. This accomplishes two things. First, the proper spacing allows the ignition flame of the M201A (fuze 28) to spread over the entire surface of delay fuze 54, thus insuring complete and rapid ignition of the delay fuze. Second, the separation disk keeps the delay fuze from hitting fuze 28 during shipping and handling. It has been found that such impact can cause the delay fuze to become ruptured and therefore non-functional, rendering the operation of the entire grenade unreliable.

Figure 4:
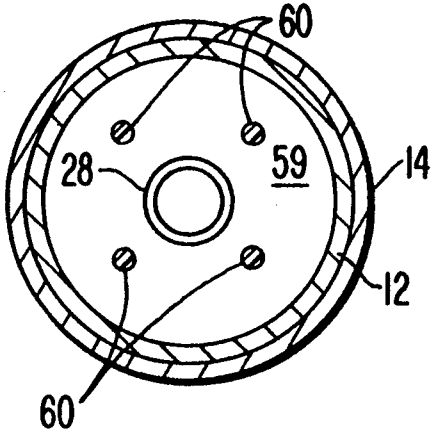
FIG. 4 is a transverse sectional view along line 4—4 of FIG. 3.
Figure 3:
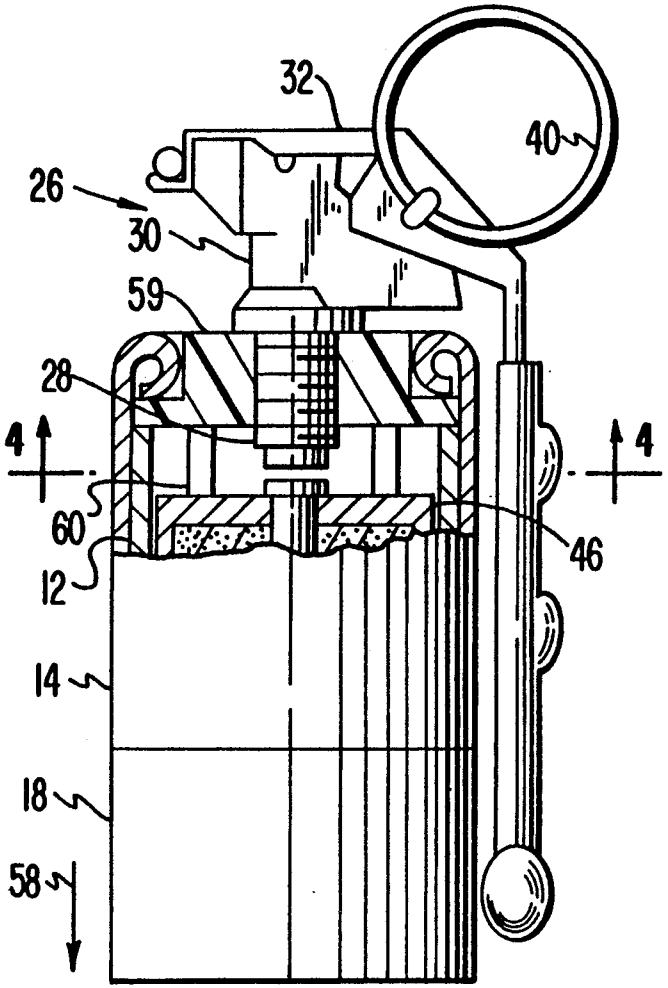
FIG. 3 is a side elevation, in partial section, of a further embodiment of a grenade in accordance with the invention.

An alternative structure for performing the function of disk 56 and also performing other functions is shown in FIGS. 3 and 4. All of the components shown in FIG. 3 are the same as in FIGS. 1 and 2 except that disk 56 is omitted and body 20 is replaced by a similar "top hat" body 59 having a plurality of legs or spikes 60 protruding from the flanged end thereof. Spikes 60 maintain the spacing discussed above and can also be used to support certain kinds of submunitions, as will be described. For these purposes, spikes 60 lie on a circle which is outside of and concentric with threaded opening 24 through body 59.

The operation of the grenade of FIGS. 1–4 is as follows. Pin 38 is extracted by ring 40 while the user holds handle 34 in the position shown in FIG. 1. The grenade is then thrown to the desired location, at which time the handle is released. The spring mechanism of fuze 26 forces the handle to pivot around pin 36 and to separate from the grenade, allowing the detonation mechanism to initiate ignition of the fuze 20 within body 30 and extending through stem 28. At the conclusion of a delay, nominally 1.8 seconds, the lower end of the fuze at the end of stem 28 ignites, producing gas under significant pressure within the housing. This gas expands and builds pressure in the air space 47. These expanding gases seep around the end of housing 10 inside of the inner wall of the end cap, providing "instant lubrication" and breaking the vacuum bond between the inner surface of the end cap and the waxed exterior wall of sleeve 12. The vinyl cap loses its adherence to the waxed cardboard and expands slightly because of the gas pressure.

This action, which takes place in somewhat less than a second, causes end cap 18 to be forced off of the end of sleeve 12. Canister 46 is then ejected out of the end of housing 10 in the direction indicated by arrow 58. Because of the specific frictional relationship between the wax coating on the outer surface of sleeve 12 and the inner surface of end cap 18, the time of ejection and the distance of travel of the charge canister from the remainder of the grenade housing is predetermined. End cap 18 is, of course, separated from the remainder of the assembly at the same time. Because the end cap is significantly larger and of much lower weight than the explosive charge canister, it falls away and is no longer of significance in the process.

The movement of canister 46 is small as compared with the end cap. This is the desired effect: the user of the grenade wants the submunition (charge canister) to stay in the same general area where the grenade is thrown. This "repeatability" of separation characteristics is an important improvement over the prior art.

The outer portion of delay fuze 54 is also ignited. This fuze can have a delay selectable in the order of 1–3 seconds, at the conclusion of which explosive material 52 within the canister is ignited and explodes.

Figure 5:
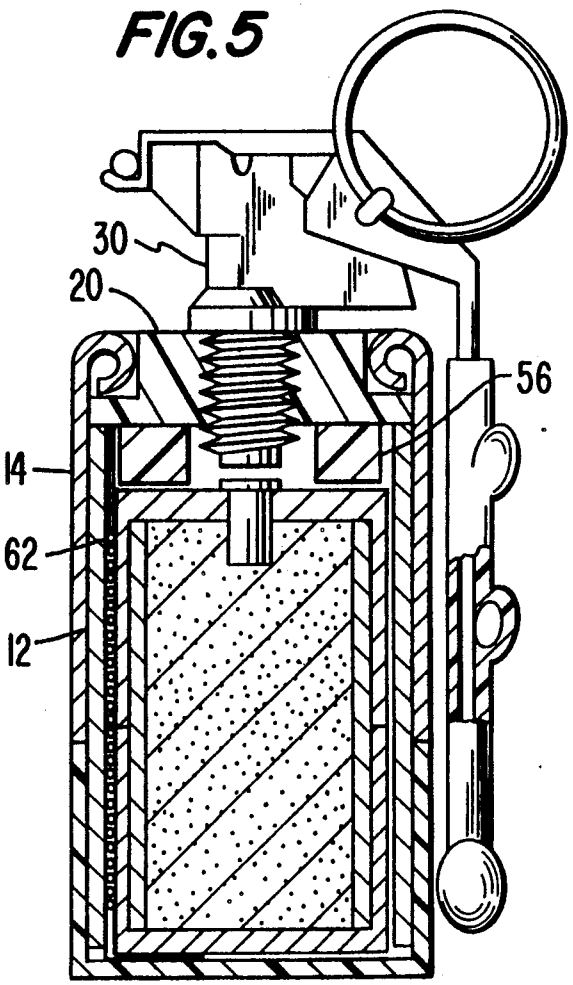
FIG. 5 is a side elevation, in partial section of another embodiment of a grenade in accordance with the invention.

A further embodiment is shown in FIG. 5 in which a tether is employed. Variations in burn time, charge composition and other factors can affect the distance between the charge and the grenade body at the time of detonation of the main charge. To control this distance, a tether 62 is included in the space between the charge 46 and the sleeve 12. One end of the tether, which is simply a length of cord several feet long, is attached to the body in any convenient fashion such as by clamping it between body 20 or 59 and sleeve 12, and the other end is attached to the submunition container 51 by adhesive or a fastener, for example. The cord is made of a material which will not readily ignite. The remainder of the cord is looped back and forth in the space. End cap 18 keeps the cord in position until the device is used. In this connection, it will be noted that attaching the end cap without using any adhesives guarantees that the tether will not be accidentally glued to the other components or otherwise encumbered so that it works in a proper fashion.

Figure 6:
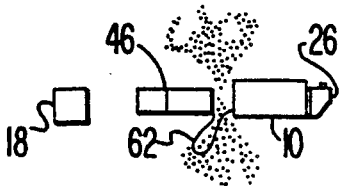
FIGS. 6 and 7 are schematic illustrations of a portion of the sequence of deployment of the explosive charge of the grenade of FIG. 5.
Figure 7:
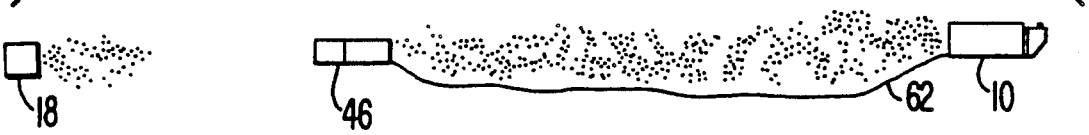

In the embodiments of FIGS. 1–5, the primary reason for separating the charge from the remainder of the grenade including the housing and fuze 26 is because the charge is intended to stun and temporarily disable a target individual (or individuals) rather than inflicting serious or lethal damage. If the fuze mechanism were allowed to remain with the charge, the fuze itself would become a dangerous piece of shrapnel, capable of wounding or killing. However, as illustrated in FIG. 6, charge 46 is separated from housing 10 and fuze assembly 26 before explosion, the charge traveling a significant distance as shown in FIG. 7 before the explosive material is ignited by fuze 54, permitting use of the grenade for disabling of a dangerous individual without inflicting serious injury.

Although the tether is illustrated in use with a grenade having a spacing disk 56, it must be pointed out that a grenade having a top hat body 59 having spikes 60 (FIGS. 3 and 4) can equally well be used with the tether.

A further embodiment of a grenade 78 in accordance with the invention is shown in FIG. 8, this embodiment illustrating two additional features of importance in the structure of the invention. First, it will be observed that the fuze structure 26 of FIGS. 1–5 has been replaced by a fuze structure 61 having a stem 65 which is threaded through the central opening of top hat fuze retention disk 59 and has a fuze end 63. Fuze structure 61 is shown attached to a fixed plate 64 by nuts 66 or the like, the fuze having wires 68 extending therefrom for connection to a remote electrical detonation system. This illustrates the principle that the separation characteristics of the grenade of the present invention can be used alone or with other like grenades and with an array of fuze devices for the purpose of propelling the munitions canisters in a specific direction, similar to a thrown grenade but using a support to control the directional characteristics of the charge. The detonation can be accomplished mechanically or, as illustrated, electrically. This permits initiation of the process from a remote location and also precise timing of the release.

The embodiment of FIG. 8 also illustrates a further modification of the grenade which can be employed in the cannon-like situation of FIG. 8 or in the hand-thrown embodiment of FIGS. 1–5, this modification being the incorporation of multiple charges. As seen in FIG. 8, munitions canister 46, which is constructed in a manner similar to FIGS. 1–5, includes a plurality (typically between 2 and 8) of separately packaged explosive charges, charges 70 and 71 being visible in FIG. 8. The number of charges is easily selectable, depending upon the size of the overall housing and the desired size of the individual charges.

Additionally, the fuze structure 61 is held in a body 59, such as that shown in FIGS. 3 and 4, with spikes 60. The number of spikes molded onto the body is chosen to equal the number of charges with which it will be used and the spikes are uniformly circularly spaced so that one spike engages the top of each charge, holding the charge securely in place and maintaining the proper spacing for ignition as previously discussed.

Figure 9:
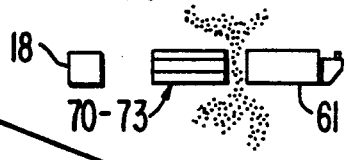
FIGS. 9 and 10 are schematic diagrams illustrating the sequence of deployment of the explosive charges from the grenade of FIG. 8.
Figure 10:
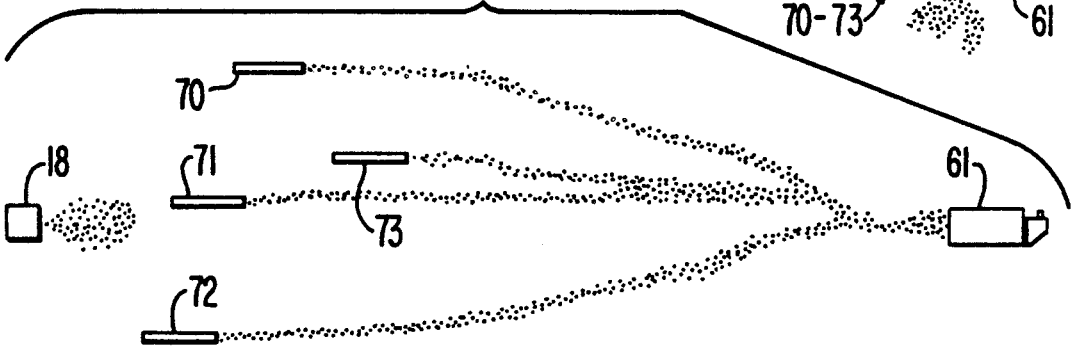

When the fuze within fuze device 61 is ignited, and after the predetermined delay of that fuze, the ignition point 63 at the inner end of fuze stem 65 is ignited, causing separation expulsion of the charge canister 46 along with removal of the end cap 18. As shown in FIGS. 9 and 10, the munitions including charges 70–73 are separated from housing 10, along with end cap 18 and disperse in a rather random fashion, as shown in FIG. 7. Each charge is provided with a delay fuze 69 which is ignited at the time of ejection, and each charge is separately detonated at a time determined by the delay of its own fuze. Preferably, the delays are chosen to be different so that the charges explode in a sequence of blasts.

As will be recognized, the grenade of the present invention provides several advantageous and unique features including a vinyl sheath over the safety spoon of the grenade which provides a comfortable and positive grip area on the safety spoon but, more importantly, provides a distinguishable color allowing the user to identify the type of grenade without having to read a label and, additionally, incorporates one or more bumps positioned on the spoon surface to create a tactile code for each type of grenade, allowing the user to distinguish one grenade from another in total darkness, even when wearing gloves.

The structure of the invention also allows safe and effective launching of charges from a pike which comprises a tubular rod several feet long with an externally threaded end which can be threaded into fuze retention disk 20 end which has an activation mechanism similar to fuze 26. The other end of the pike rod is provided with a trigger mechanism for activation of the grenade. This arrangement is useful for launching charges into a second floor window or a small opening of a building which is above reachable height and too small for a grenade to be reliably thrown into. The pike can also be carried by police in riot control situations in which it may be necessary to launch charges into a crowd.

The grenade of the present invention can also be launched by a crossbow. By screwing disk 20 or 59 onto the threaded end of a crossbow bolt, the grenade can be silently launched a great distance. Activation of the grenade can be by a delay fuze in the bolt or the grenade or by impact.

Figure 11:
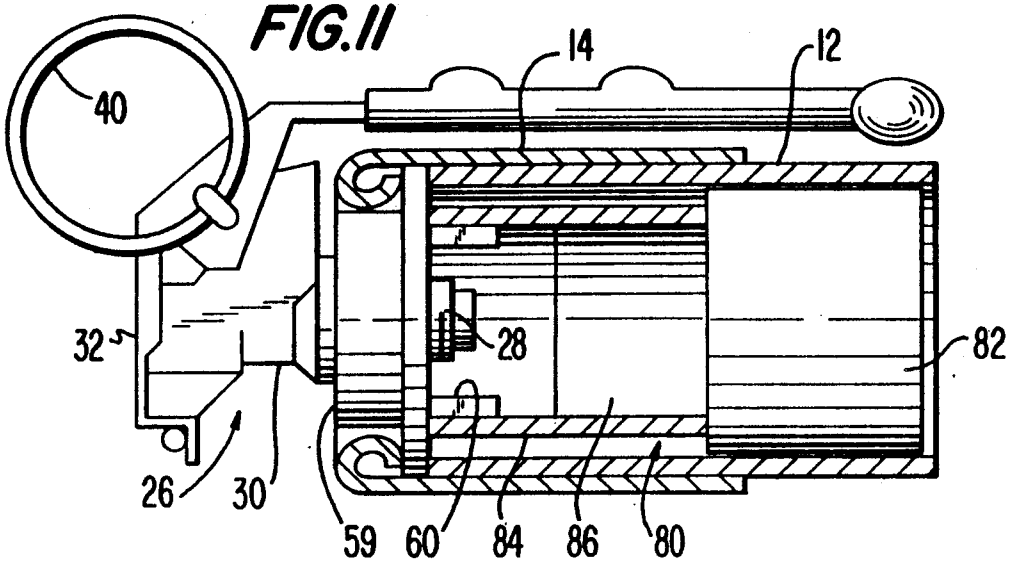
FIGS. 11 and 12 are side elevations, in partial section of yet another embodiment of the invention, FIG. 11 showing the grenade in assembled form and FIG. 12 showing the same grenade at the beginning of launch.
Figure 12:
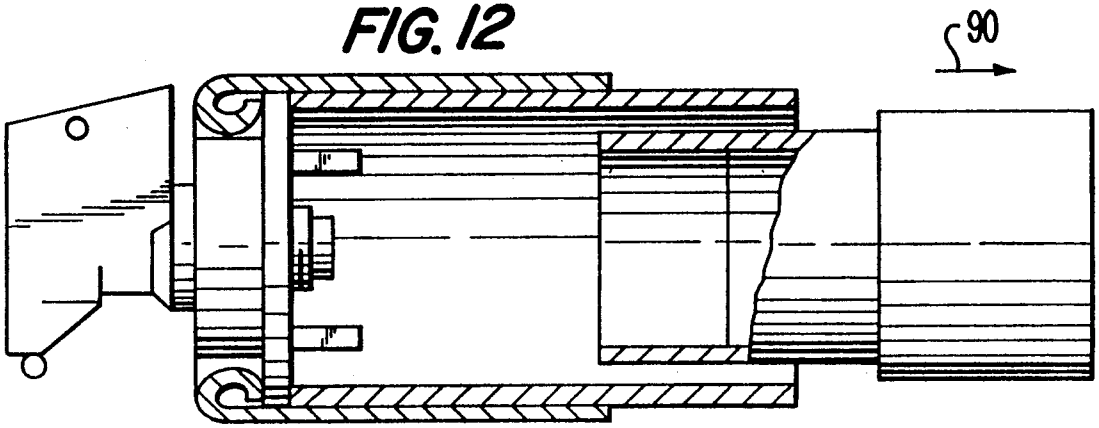

FIGS. 11 and 12 show an embodiment of the invention which makes further use of the spikes 60 molded onto the "tophat" body 59 for launching a charge from the grenade body. The grenade body is essentially as shown in earlier figures and includes sleeves 12 and 14, body 59 with its flange held between the sleeves and a fuze device 26. Cap 18 is omitted, although it can be present for shipping and storage.

Within the grenade body is a launchable charge canister indicated generally at 80. Canister 80 includes a primary charge 82 which is the main charge to be detonated near the target. Charge 82 is attached to a tubular sleeve 84 of cardboard or the like which is dimensioned to closely engage spikes 60. In the embodiment shown, sleeve 84 is dimensioned to surround the spikes, but in some constructions it may be desirable for the sleeve to fit on the inside of the spikes, depending on the relative dimensions of the body and launchable canister. Within sleeve 84 is a propellant or separation charge 86 having a surface 87 exposed to the inner end of fuze 28.

When ring 40 is extracted and the handle is released allowing the fuze mechanism to operate and, after its delay, to ignite, the propellant charge is ignited, creating gas pressure within sleeve 84. The spikes hold the canister until sufficient gas pressure builds up to pull the sleeve from the spikes and move the entire canister in the direction of arrow 90 (FIG. 12) for a distance determined by the size and characteristics of the propellant charge.

For purposes of using the launchable canister, a conventional electric pistol-grip type of fuze assembly can conveniently be used in place of the M201A.

The structure of the grenade of the present invention includes a unique multiple-function fuze retention disk arrangement which is held in the end of the grenade housing by curled rim portion 16 and sleeve 12, providing a location at which anyone of a variety of different types of fuzes can be threaded for interaction with anyone of several possible munitions arrangements within the housing. The fuze can be a standard fuze assembly or a remotely actuated electric or other ignition system. The fuze retention disk allows the munitions to be used as a "shell", permitting the munitions to be fired like a standard projectile device. Arranging a plurality of grenades on a mounting plate such as illustrated in FIG. 8 permits the grenade of the invention to be used as part of a multiple ejection rack system to deploy multiple grenades in a stationary defense system, as for a building location. The grenades can be ignited remotely to fire individually or in volleys.

Additionally, the basic grenade body including the housing and the fuze retention disk is reusable a number of times because it is separated from the charge before detonation. The screw-in fuze and replaceable expendable components of the grenade (end cap, munitions canister and fuze) allow the grenade to be reloaded and used again. The flange of the fuze retention disk firmly secures the disk in the end of the grenade to withstand forces associated with ignition of the separation charge 56 or 78.

While certain advantageous embodiments have been chosen to illustrate the invention, it will be understood by those skilled in the art that various changes and modifications can be made therein without departing from the scope of the invention as defined in the appended claims.

What is claimed is:

1. A grenade comprising a generally tubular housing having open ends;

a munitions container slidably received within said housing, said munitions container having an ignitable fuze;

a cup-shaped end cap closing one end of said housing and surrounding and frictionally engaging the outer surface of said housing adjacent said one end, said external surface of said housing adjacent said one end being coated with wax, said end cap being made of a soft polyvinyl chloride dimensioned to mate with said wax-coated surface, whereby said cap is securely retained on said housing by friction and exhibits a substantially constant resistance to removal under varying conditions of temperature and humidity;

closure means at the other end of said housing attachable to a delay fuze, said closure means including a fuze retention disk comprising a main body, an annular flange protruding radially from said main body, said flange of said fuze retention disk being no greater than one-half the thickness of said main body, means defining an internally threaded opening passing through said main body for receiving said fuze, and a plurality of spikes protruding from a surface of said body to said munitions container to thereby establish a predetermined spacing between said delay fuze and said ignition fuze; and means for securing said fuze retention disk in said other end of said housing.

2. A grenade according to claim 1 wherein said fuze retention disk is attached to a fuze of the type comprising a spring-operated igniter fuze having a mounting bracket, a spring-urged igniter arm pivotally mounted on said bracket, a releasable safety spoon attached to said bracket for restraining the igniter arm its restraining position, wherein said spoon comprises an elongated metal member;

means forming a preselected number of one or more enlargements attached to said metal member, the number of enlargements being selected to indicate a characteristic of a charge in said munitions container; and a sheath substantially uniformly covering said metal member and said enlargements.

3. A grenade according to claim 2 wherein said housing includes an inner tubular member one end of which is covered by said end cap; and an outer tubular body surrounding that portion of said inner tubular member not covered by said end cap and extending axially beyond the other end of said inner tubular member, said axially extending portion thereof being rolled inwardly to form a rim of reduced diameter to receive said main body of said fuze retention disk and to form said means for retention, said flange of said fuze retention disk extending between said rolled portion and said other end of said inner tubular member.

4. A grenade according to claim 1 wherein said munitions container includes a plurality of separable charge packages which are dispersed when said canister is expelled from said housing.

5. A grenade comprising a generally tubular housing having open ends;

a munitions container slidably received within said housing, said munitions container having an ignitable fuze;

a cup-shaped end cap closing one end of said housing and surrounding and frictionally engaging the outer surface of said housing adjacent said one end, closure means at the other end of said housing attachable to a delay fuze, said closure means including a fuze retention disk comprising a main body, an annular flange protruding radially from said main body, means defining an internally threaded opening passing through said main body for receiving said fuze, and a plurality of spikes protruding from a surface of said body to said munitions container to thereby establish a predetermined spacing between said delay fuze and said ignition fuze; and means for securing said fuze retention disk in said other end of said housing, and wherein said fuze retention disk is attached to a fuze of the type comprising a spring-operated igniter fuze having a mounting bracket, a spring-urged igniter arm pivotally mounted on said bracket, a releasable safety spoon attached to said bracket for restraining the igniter arm and a removable locking pin holding the safety spoon in its restraining position, said spoon comprising an elongated metal member;

means forming a preselected number of one or more enlargements attached to said metal member, the number of enlargements being selected to indicate a characteristic of a charge in said munitions container; and a sheath of substantially uniform thickness covering said metal member and said enlargements.

6. A stun grenade comprising a generally tubular housing having open ends;

a munitions container slidable into and out of one end of said housing, said munitions container having an ignitable fuze;

closure means at the other end of said housing attachable to a delay fuze, said closure means including a fuze retention disk comprising a main body, an annular flange protruding radially from said main body, and means defining an internally threaded opening passing through said main body for engaging external threads on said fuze;

means for establishing and maintaining a predetermined spacing between said fuze held in said retention disk and said ignitable fuze on said munitions container, said means for establishing spacing including a plurality of spikes protruding from a surface of said main body and abutting spaced apart locations on an end surface of said munitions container; and means for securing said fuze retention disk in said other end of said housing.

7. A stun grenade comprising a generally tubular housing having open ends;

a munitions container slidable into and out of one end of said housing, said munitions container having an ignitable fuze;

closure means at the other end of said housing attachable to a delay fuze, said closure means including a fuze retention disk comprising a main body, an annular flange protruding radially from said main body, and means defining an internally threaded opening passing through said main body for engaging external threads on said fuze;

means for establishing and maintaining a predetermined spacing between said fuze held in said retention disk and said ignitable fuze on said munitions container, said means for establishing spacing comprising an annular body of material between and in contact with said main body of said munitions container; and means for securing said fuze retention disk in said other end of said housing.

8. A stun grenade comprising a generally tubular housing having open ends;

a munitions container slidable into and out of one end of said housing, said munitions container having an ignitable fuze;

closure means at the other end of said housing attachable to a delay fuze, said closure means including a fuze retention disk comprising a main body, an annular flange protruding radially from said main body, and means defining an internally threaded opening passing through said main body for engaging external threads on said fuze;

means for establishing and maintaining a predetermined spacing between said fuze held in said retention disk and said ignitable fuze on said munitions container; and means for securing said fuze retention disk in said other end of said housing, and an elongated cord forming a tether between said housing and said munitions container to limit the separation therebetween.

9. A stun grenade comprising a generally tubular housing having open ends;

a munitions container slidable into and out of one end of said housing, said munitions container having an ignitable separation charge, a primary charge and a mounting sleeve surrounding and extending beyond said separation charge;

closure means at the other end of said housing attachable to a fuze, said closure means including a fuze retention disk comprising a main body, an annular flange protruding radially from said main body, means defining an internally threaded opening passing through said main body for engaging external threads on said fuze, and a plurality of spikes protruding from said main body into said housing, said spikes being arranged to engage and support said mounting sleeve; and means for securing said fuze retention disk in said other end of said housing, whereby said munitions container is held within said housing on said retention disk spikes until said fuze ignites and ignites said separation charge, whereupon said munitions container is expelled from said housing.

* * * * *